US009821198B2

(12) United States Patent
Stokke

(10) Patent No.: US 9,821,198 B2
(45) **Date of Patent: *Nov. 21, 2017**

(54) CLUB HEAD WITH SOLE MASS ELEMENT AND RELATED METHOD

(71) Applicant: KARSTEN MANUFACTURING CORPORATION, Phoenix, AZ (US)

(72) Inventor: Ryan Stokke, Phoenix, AZ (US)

(73) Assignee: Karsten Manufactuing Corporation, Phoenix, AZ (US)

( * ) Notice: Subject to any disclaimer, the term of this patent is extended or adjusted under 35 U.S.C. 154(b) by 55 days.

This patent is subject to a terminal disclaimer.

(21) Appl. No.: 14/940,488

(22) Filed: Nov. 13, 2015

(65) Prior Publication Data

US 2016/0067568 A1 Mar. 10, 2016

Related U.S. Application Data

(63) Continuation of application No. 13/959,449, filed on Aug. 5, 2013, now Pat. No. 9,205,311, which is a continuation-in-part of application No. 29/447,491, filed on Mar. 4, 2013, now Pat. No. Des. 687,503.

(51) Int. Cl.
*A63B 53/04* (2015.01)
*A63B 53/06* (2015.01)

(52) U.S. Cl.
CPC ..... *A63B 53/0466* (2013.01); *A63B 53/06* (2013.01); *A63B 2053/0408* (2013.01); *A63B 2053/0412* (2013.01); *A63B 2053/0433* (2013.01); *A63B 2053/0491* (2013.01); *Y10T 29/49826* (2015.01)

(58) Field of Classification Search
USPC ..... 473/324–350
See application file for complete search history.

(56) References Cited

U.S. PATENT DOCUMENTS

| | | | |
|---|---|---|---|
| 1,993,928 | A | 3/1935 | Glover |
| 2,041,676 | A | 5/1936 | Gallagher |
| 2,756,055 | A | 7/1956 | Bittner |
| D248,179 | S | 6/1978 | Riley |
| 4,139,196 | A | 2/1979 | Riley |
| 4,762,322 | A | 8/1988 | Molitor et al. |
| 4,874,171 | A | 10/1989 | Ezaki et al. |
| D307,783 | S | 5/1990 | Iinuma |
| 5,221,086 | A | 6/1993 | Antonious |
| 5,310,186 | A | 5/1994 | Karsten |
| 5,335,914 | A | 8/1994 | Long |
| D352,755 | S | 11/1994 | Cornish, III |
| D357,290 | S | 4/1995 | Viollaz |
| 5,501,459 | A | 3/1996 | Endo |
| 5,547,188 | A | 8/1996 | Dumontier |
| D379,391 | S | 5/1997 | Moore |
| 5,658,206 | A | 8/1997 | Antonious |
| D383,511 | S | 9/1997 | Lo |
| 5,795,245 | A | 8/1998 | Chang |

(Continued)

FOREIGN PATENT DOCUMENTS

| | | | |
|---|---|---|---|
| JP | 10244022 | A | 9/1998 |
| JP | 2000300701 | A | 10/2000 |

(Continued)

*Primary Examiner* — Alvin Hunter

(57) ABSTRACT

Some embodiments include a club head with sole mass element. Other embodiments of related club heads and methods are also disclosed.

20 Claims, 7 Drawing Sheets

(56) References Cited

U.S. PATENT DOCUMENTS

| | | | |
|---|---|---|---|
| D398,682 | S | 9/1998 | Moore |
| D402,340 | S | 12/1998 | Sheets |
| D404,098 | S | 1/1999 | Ishikawa |
| 5,967,905 | A | 10/1999 | Nakahara et al. |
| 5,980,394 | A | 11/1999 | Domas |
| D418,888 | S | 1/2000 | Williams |
| D425,589 | S | 5/2000 | Ishikawa |
| D426,604 | S | 6/2000 | Besnard |
| 6,074,310 | A | 6/2000 | Ota |
| 6,080,069 | A | 6/2000 | Long |
| D433,073 | S | 10/2000 | Sodano |
| D441,818 | S | 5/2001 | Sato |
| D442,245 | S | 5/2001 | Roach |
| D445,470 | S | 7/2001 | Teramoto |
| 6,254,494 | B1 | 7/2001 | Hasebe et al. |
| D446,268 | S | 8/2001 | Satoh |
| D446,563 | S | 8/2001 | Besnard |
| 6,319,149 | B1 | 11/2001 | Lee |
| 6,340,337 | B2 | 1/2002 | Hasebe et al. |
| 6,341,723 | B1 | 1/2002 | Nakahara et al. |
| 6,386,990 | B1 | 5/2002 | Reyes et al. |
| D461,865 | S | 8/2002 | Nagai |
| D463,838 | S | 10/2002 | Besnard |
| D465,251 | S | 11/2002 | Wood |
| 6,475,102 | B2 | 11/2002 | Helmstetter |
| D469,141 | S | 1/2003 | Poynor |
| D472,950 | S | 4/2003 | Burnett |
| 6,547,676 | B2 | 4/2003 | Cackett et al. |
| D482,421 | S | 11/2003 | Kessler |
| 6,669,580 | B1 | 12/2003 | Cackett et al. |
| 6,676,535 | B2 | 1/2004 | Sheets et al. |
| D490,489 | S | 5/2004 | Madore |
| D492,745 | S | 7/2004 | Tang |
| D501,036 | S | 1/2005 | Burrows |
| D502,976 | S | 3/2005 | Nishitani |
| D508,544 | S | 8/2005 | Madore |
| D509,272 | S | 9/2005 | Smith |
| 6,939,247 | B1 | 9/2005 | Schweigert et al. |
| D513,424 | S | 1/2006 | Erickson |
| D514,179 | S | 1/2006 | Chen |
| 6,984,180 | B2 | 1/2006 | Hasebe |
| 6,988,960 | B2 | 1/2006 | Mahaffey et al. |
| D518,129 | S | 3/2006 | Poynor |
| D518,543 | S | 4/2006 | Aguinaldo |
| D521,093 | S | 5/2006 | Jorgensen |
| D522,077 | S | 5/2006 | Schweigert |
| D522,601 | S | 6/2006 | Schweigert |
| D523,103 | S | 6/2006 | Hocknell |
| D523,498 | S | 6/2006 | Chen |
| D523,502 | S | 6/2006 | Jorgensen |
| D526,694 | S | 8/2006 | Schweigert |
| D529,111 | S | 9/2006 | Cleveland |
| D530,761 | S | 10/2006 | Evans |
| D532,473 | S | 11/2006 | Chen |
| D532,474 | S | 11/2006 | Bennett |
| D532,854 | S | 11/2006 | Oldknow |
| 7,137,905 | B2 | 11/2006 | Kohno |
| 7,147,572 | B2 | 12/2006 | Kohno |
| D535,343 | S | 1/2007 | Chen |
| D536,049 | S | 1/2007 | Evans |
| D537,139 | S | 2/2007 | Breier |
| D537,495 | S | 2/2007 | Schweigert |
| D537,496 | S | 2/2007 | Serrano |
| D537,895 | S | 3/2007 | Breier |
| D538,363 | S | 3/2007 | Schweigert |
| D538,371 | S | 3/2007 | Kawami |
| D538,866 | S | 3/2007 | Kim |
| D538,867 | S | 3/2007 | Cleveland |
| D539,371 | S | 3/2007 | Serrano |
| D541,364 | S | 4/2007 | Barez |
| D545,389 | S | 6/2007 | Glod |
| D547,815 | S | 7/2007 | Tang |
| D550,318 | S | 9/2007 | Oldknow |
| D550,799 | S | 9/2007 | Lin |
| D552,198 | S | 10/2007 | Schweigert |
| D553,206 | S | 10/2007 | Morales |
| D555,745 | S | 11/2007 | Rollinson |
| D557,362 | S | 12/2007 | Serrano |
| D557,363 | S | 12/2007 | Jertson |
| D558,287 | S | 12/2007 | Jertson |
| D558,288 | S | 12/2007 | Jertson |
| D561,286 | S | 2/2008 | Morales |
| D562,421 | S | 2/2008 | Jertson |
| 7,326,472 | B2 | 2/2008 | Shimazaki et al. |
| D563,498 | S | 3/2008 | Jertson |
| D564,054 | S | 3/2008 | Jertson |
| D564,055 | S | 3/2008 | Jertson |
| D564,056 | S | 3/2008 | Chen |
| D566,214 | S | 4/2008 | Evans |
| D567,317 | S | 4/2008 | Jertson |
| D567,891 | S | 4/2008 | Serrano |
| D569,933 | S | 5/2008 | Jertson |
| D569,934 | S | 5/2008 | Jertson |
| D569,935 | S | 5/2008 | Schweigert |
| D569,936 | S | 5/2008 | Schweigert |
| D569,937 | S | 5/2008 | Sanchez |
| D569,938 | S | 5/2008 | Sanchez |
| 7,377,860 | B2 | 5/2008 | Breier et al. |
| D570,937 | S | 6/2008 | Schweigert |
| D570,938 | S | 6/2008 | Jertson |
| D570,939 | S | 6/2008 | Chen |
| D570,940 | S | 6/2008 | Chen |
| D570,941 | S | 6/2008 | Chen |
| D571,882 | S | 6/2008 | Sorracco |
| D572,324 | S | 7/2008 | Chen |
| D572,782 | S | 7/2008 | Sanchez |
| D572,783 | S | 7/2008 | Sanchez |
| D572,784 | S | 7/2008 | Sanchez |
| D572,785 | S | 7/2008 | Chen |
| D572,787 | S | 7/2008 | Sanchez |
| D572,791 | S | 7/2008 | Jertson |
| D573,213 | S | 7/2008 | Sanchez |
| D573,214 | S | 7/2008 | Sanchez |
| D573,215 | S | 7/2008 | Sanchez |
| D573,216 | S | 7/2008 | Sanchez |
| D573,217 | S | 7/2008 | Sanchez |
| D573,218 | S | 7/2008 | Sanchez |
| D573,674 | S | 7/2008 | Sanchez |
| D573,675 | S | 7/2008 | Sanchez |
| D573,676 | S | 7/2008 | Chen |
| D573,678 | S | 7/2008 | Kawami |
| D574,046 | S | 7/2008 | Chen |
| D574,048 | S | 7/2008 | Kadoya |
| D574,049 | S | 7/2008 | Kadoya |
| D574,050 | S | 7/2008 | Jones |
| 7,396,296 | B2 | 7/2008 | Evans |
| D574,456 | S | 8/2008 | Chen |
| D578,587 | S | 10/2008 | Hoffman |
| D579,066 | S | 10/2008 | Dipert |
| D579,067 | S | 10/2008 | Hoffman |
| D580,504 | S | 11/2008 | Bosilkovski |
| D583,432 | S | 12/2008 | Serrano |
| D587,772 | S | 3/2009 | Ferugson |
| D588,217 | S | 3/2009 | Jertson |
| D588,220 | S | 3/2009 | Ferugson |
| D588,659 | S | 3/2009 | Jertson |
| D589,576 | S | 3/2009 | Kadoya |
| 7,503,854 | B2 | 3/2009 | Galloway et al. |
| 7,524,249 | B2 | 4/2009 | Breier et al. |
| D591,810 | S | 5/2009 | Murphy |
| D591,817 | S | 5/2009 | Murphy |
| D591,818 | S | 5/2009 | Roberts |
| D594,518 | S | 6/2009 | Schweigert |
| D594,521 | S | 6/2009 | Jertson |
| D594,919 | S | 6/2009 | Schweigert |
| D595,381 | S | 6/2009 | Waggoner |
| D596,252 | S | 7/2009 | Jertson |
| D598,062 | S | 8/2009 | Dipert |
| D600,297 | S | 9/2009 | Jertson |
| D603,472 | S | 11/2009 | Schweigert |
| D603,919 | S | 11/2009 | Gray |
| D604,376 | S | 11/2009 | Darley |
| 7,648,426 | B2 | 1/2010 | Evans |
| D609,293 | S | 2/2010 | Williams |

(56) References Cited

U.S. PATENT DOCUMENTS

| | | | |
|---|---|---|---|
| D609,294 | S | 2/2010 | Oldknow |
| D611,555 | S | 3/2010 | Oldknow |
| D612,005 | S | 3/2010 | Oldknow |
| D613,805 | S | 4/2010 | Sutovsky |
| D618,747 | S | 6/2010 | Schweigert et al. |
| D618,753 | S | 6/2010 | Jertson |
| D618,754 | S | 6/2010 | Schweigert et al. |
| D621,892 | S | 8/2010 | Kohno |
| 7,803,065 | B2 | 9/2010 | Breier et al. |
| 7,837,577 | B2 | 11/2010 | Evans |
| 7,892,111 | B2 | 2/2011 | Morales |
| D635,626 | S | 4/2011 | Nicolette |
| D638,896 | S | 5/2011 | Schweigert |
| 7,934,999 | B2 | 5/2011 | Cackett et al. |
| 7,938,740 | B2 | 5/2011 | Breier et al. |
| 8,012,034 | B1 | 9/2011 | Cackett |
| 8,088,021 | B2 | 1/2012 | Albertsen et al. |
| D654,130 | S | 2/2012 | Glod |
| D661,751 | S | 6/2012 | Nicolette et al. |
| D661,752 | S | 6/2012 | Stokke |
| D661,756 | S | 6/2012 | Nicolette et al. |
| D661,757 | S | 6/2012 | Stokke |
| 8,337,326 | B2 | 12/2012 | Lukasiewicz, Jr. |
| 8,337,328 | B2 | 12/2012 | Foster et al. |
| D673,630 | S | 1/2013 | Schweigert |
| 8,388,465 | B2 | 3/2013 | De La Cruz et al. |
| D680,179 | S | 4/2013 | Solheim et al. |
| 8,475,293 | B2 | 7/2013 | Morin et al. |
| 8,523,705 | B2 | 9/2013 | Breier et al. |
| D691,321 | S | 10/2013 | Chen et al. |
| 8,550,936 | B1 | 10/2013 | Burnett et al. |
| 8,579,729 | B2 | 11/2013 | Nelson et al. |
| 8,608,589 | B2 | 12/2013 | Ferguson et al. |
| 8,684,863 | B2 | 4/2014 | Bezilla et al. |
| 8,708,838 | B2 | 4/2014 | Ferguson et al. |
| 8,858,359 | B2 | 10/2014 | Willett et al. |
| 8,926,450 | B2 | 1/2015 | Takahashi et al. |
| 9,205,311 | B2 * | 12/2015 | Stokke ..... A63B 53/06 |
| 2005/0043117 | A1 | 2/2005 | Gilbert |
| 2008/0039228 | A1 | 2/2008 | Breier |
| 2008/0171612 | A1 | 7/2008 | Serrano |
| 2008/0188322 | A1 | 8/2008 | Anderson |
| 2009/0275419 | A1 | 11/2009 | Cackett |
| 2010/0331096 | A1 | 12/2010 | Curtis et al. |
| 2011/0143858 | A1 | 6/2011 | Peralta |

FOREIGN PATENT DOCUMENTS

| | | | |
|---|---|---|---|
| JP | 2001017587 | A | 1/2001 |
| JP | 2001224713 | A | 8/2001 |
| JP | 2002085607 | A | 3/2002 |

* cited by examiner

CLUB HEAD WITH SOLE MASS ELEMENT AND RELATED METHOD

CROSS-REFERENCE TO RELATED APPLICATIONS

This application is a continuation of U.S. application Ser. No. 13/959,449, filed Aug. 5, 2013, which is a continuation-in-part of U.S. Design application Ser. No. 29/447,491, filed Mar. 4, 2013, both of which are incorporated herein by reference in their entirety.

TECHNICAL FIELD

This disclosure relates generally to sports equipment, and relates more particularly to club heads and related methods.

BACKGROUND

Various characteristics of a golf club including the center of gravity and moment of inertia of the club head of the golf club can affect the performance of the golf club. The center of gravity and moment of inertia of the club head of the golf club are functions of the distribution of mass of the club head. In particular, distributing mass of the club head to be closer to a sole of the club head, farther from a face of the club head, and/or closer to toe and heel ends of the club head can alter the center of gravity and/or the moment of inertia of the club head. For example, distributing mass of the club head to be closer to the sole of the club head and/or farther from the face of the club head can increase a flight angle of a golf ball struck with the club head. Meanwhile, increasing the flight angle of a golf ball can increase the distance the golf ball travels. Further, distributing mass of the club head to be closer to the toe and/or heel ends of the club head can affect the moment of inertia of the club head, which can alter the forgiveness of the golf club.

BRIEF DESCRIPTION OF THE DRAWINGS

To facilitate further description of the embodiments, the following drawings are provided in which.

Figure 1:
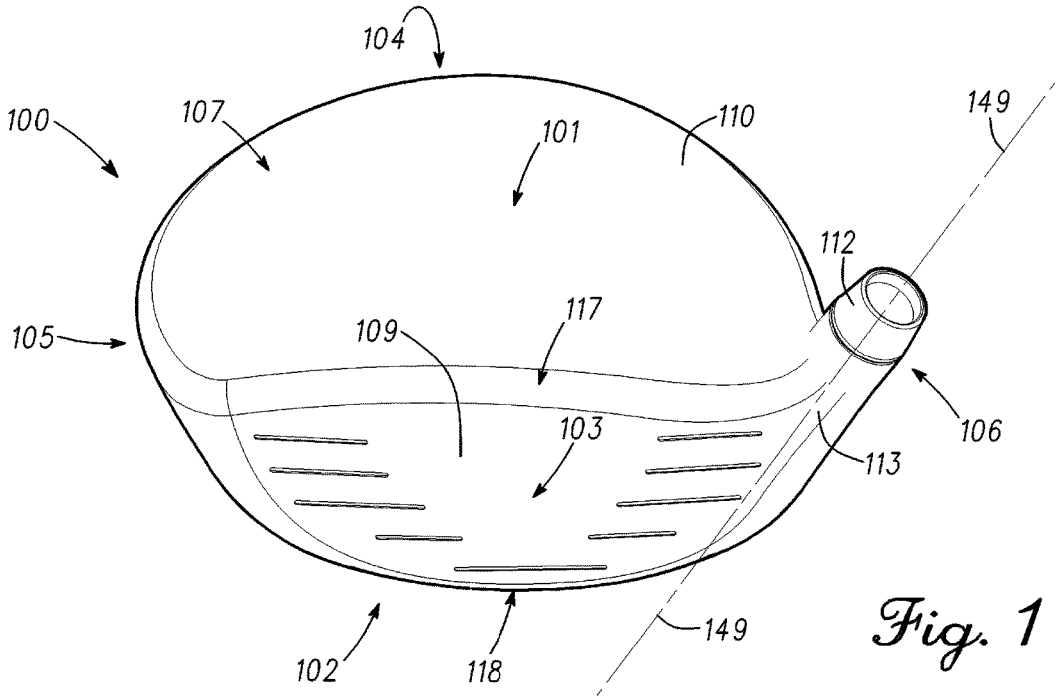
FIG. 1 illustrates a top, front view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or ±10.0% of the related value(s), range(s) of values, relationship(s), parameter(s), or condition(s), as applicable.

DESCRIPTION

Some embodiments include a golf club head. The golf club head comprises a club head body and a sole mass element configured to be coupled to the club head body. The golf club head comprises a club head center of gravity (CG) and at least one keel point. Further, the club head CG comprises a club head CG height being a distance that is parallel to a top-bottom axis of the golf club head between the club head CG and the at least one keel point. When the sole mass element is coupled to the club head body, the club head CG height can be less than or equal to approximately 1.415 centimeters.

Other embodiments include a golf club head. The golf club head comprises a club head body comprising a sole surface. The golf club head also comprises a sole mass element configured to be removably and mechanically coupled to the club head body. The golf club head comprises a club head center of gravity (CG) and at least one keel point. Further, the club head CG comprises a club head CG height being a distance that is parallel to a top-bottom axis of the golf club head between the club head CG and the at least one keel point. When the sole mass element is coupled to the club head body, the club head CG height can be less than or equal to approximately 1.415 centimeters. Further, when the sole mass element is coupled to the club head body, the sole mass element can comprise an exposed surface, the exposed surface of the sole mass element can comprise a surface area; and the surface area of the exposed surface of the sole mass element can be greater than or equal to approximately 3 square centimeters and less than or equal to approximately 39 square centimeters. Further still, the sole surface can comprise a sole mass element cavity configured to receive the sole mass element. The sole mass element can be configured to be coupled to the club head body at the sole mass element cavity. Meanwhile, the sole mass element can comprise a sole mass element material, and the sole mass element material can comprise a specific gravity greater than or equal to approximately 16 and/or a metal injection molded material.

Further embodiments include a method of providing a golf club head. The method can comprise: providing a club head body; and providing a sole mass element configured to be coupled to the club head body. The golf club head comprises a club head center of gravity (CG) and at least one keel point. Further, the club head CG comprises a club head CG height being a distance that is parallel to a top-bottom axis of the golf club head between the club head CG and the at least one keel point. Further still, when the sole mass element is coupled to the club head body, the club head CG height can be less than or equal to approximately 1.415 centimeters.

Figure 2:
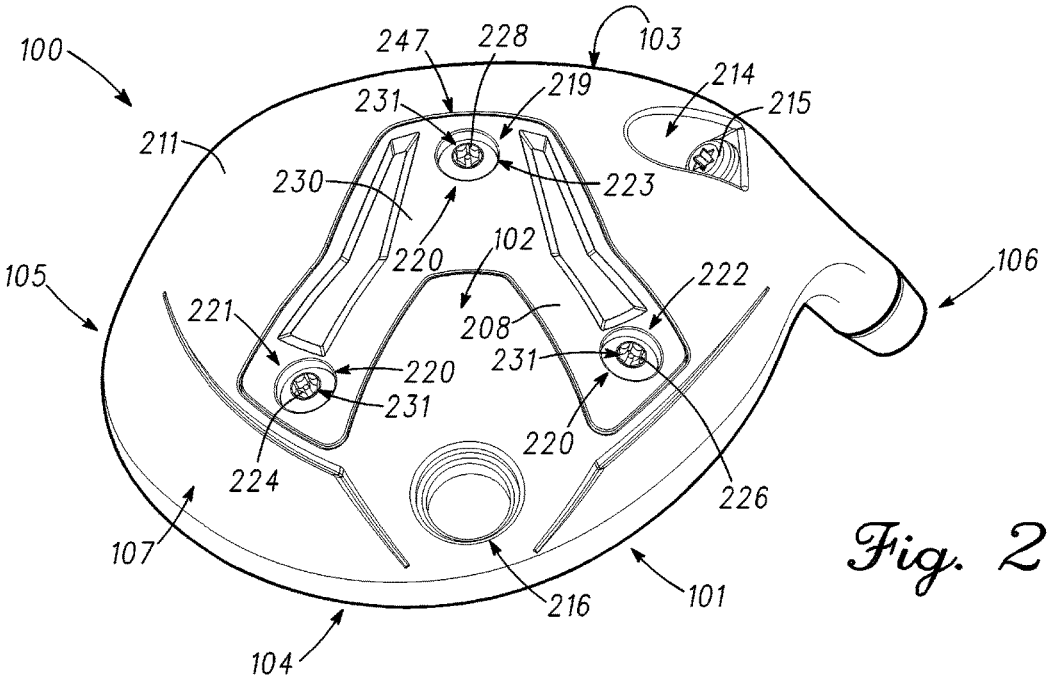
FIG. 2 illustrates a bottom, rear view of club head, according to the embodiment of FIG. 1.

Turning to the drawings, FIG. 1 illustrates a top, front view of a club head 100, according to an embodiment. Meanwhile, FIG. 2 illustrates a bottom, rear view of club head 100, according to the embodiment of FIG. 1. Club head 100 is merely exemplary and is not limited to the embodiments presented herein. Club head 100 can be employed in many different embodiments or examples not specifically depicted or described herein.

Generally, club head 100 can comprise a golf club head. The golf club head can be part of a corresponding golf club. Further, the golf club head can be part of a set of golf club heads, and/or the golf club can be part of a set of golf clubs. For example, club head 100 can comprise any suitable wood-type golf club head (e.g., a driver club head, a fairway wood club head, a hybrid club head, etc.). In many embodiments, club head 100 can comprise a metal wood-type golf club head, but in these or other embodiments, club head 100 can comprise any suitable materials. Suitable materials for implementing club head 100 and one or more advantages of using particular material for implementing club head 100 are discussed in greater detail below. Nonetheless, although club head 100 is generally described in implementation with respect to a wood-type golf club, club head 100 can also be implemented with any other suitable golf club-type. The apparatus, methods, and articles of manufactured described herein are not limited in this regard.

Referring to FIG. 1, club head 100 comprises a top end 101 and a bottom end 102 opposite top end 101, a front end 103 and a rear end 104 opposite front end 103, and a toe end 105 and a heel end 106 opposite toe end 105. Further, club head 100 comprises a club head body 107 and a sole mass element 208 (FIG. 2). Club head body 107 can be solid, hollow, or partially hollow. When club head body 107 is hollow and/or partially hollow, club head body 107 can comprise a shell structure, and further, can be filled and/or partially filled with a filler material different from a material of shell structure. For example, the filler material can comprise plastic foam.

Meanwhile, club head body 107 can comprise a face surface 109, a crown surface 110, a sole surface 211 (FIG. 2) and/or a skirt surface (not illustrated). Further, club head body 107 can comprise hosel 112 and/or hosel transition portion 113, or can comprise a bore (not illustrated). Further still, club head body 107 and/or sole surface 211 (FIG. 2) can comprise a hosel port 214 (FIG. 2), a hosel bolt 215 (FIG. 2), one or more weight ports 216 (FIG. 2), one or more weights 956 (FIG. 9), and/or a sole mass element cavity 219 (FIG. 2). In various embodiments, one or more of the skirt surface, hosel 112, hosel transition portion 113, the bore, hosel port 214 (FIG. 2), hosel port bolt 215 (FIG. 2), weight port(s) 216 (FIG. 2), weight(s) 956 (FIG. 9), and sole mass element cavity 219 (FIG. 2) can be omitted.

Figure 9:
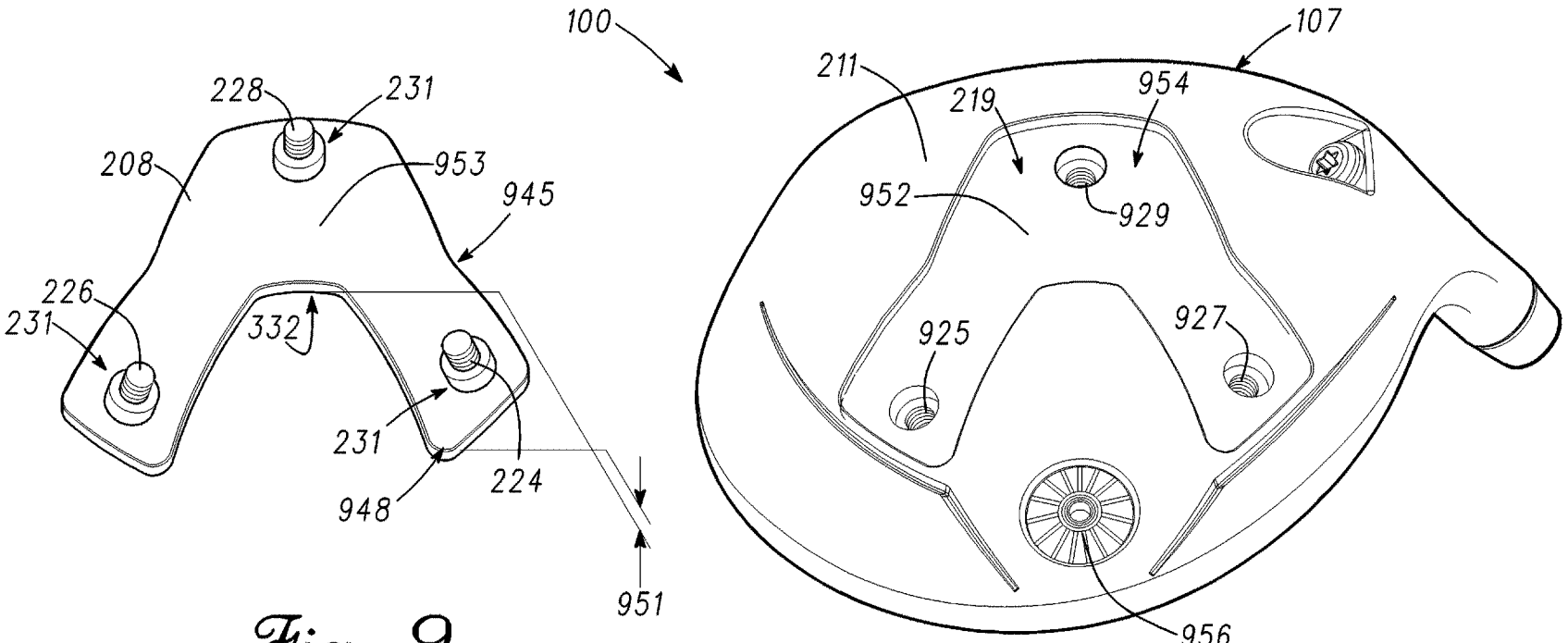
FIG. 9 illustrates the club head when a sole mass element of the club head is decoupled from a club head body of the club head, according to the embodiment of FIG. 1.

Turning ahead briefly to FIG. 2, in some embodiments, club head body 107 can comprise one or more coupling mechanisms 220 (e.g., a first coupling mechanism 221, a second coupling mechanism 222, and/or a third coupling mechanism 223). Each of coupling mechanism(s) 220 can comprise a fastener and/or a receiver. For example, first coupling mechanism 221 can comprise first fastener 224 and first receiver 925 (FIG. 9); second coupling mechanism 222 can comprise second fastener 226 and second receiver 927 (FIG. 9); and/or third coupling mechanism 223 can comprise third fastener 228 and third receiver 929 (FIG. 9). In other embodiments, one or more of coupling mechanisms 220, first coupling mechanism 221, second coupling mechanism 222, third coupling mechanism 223, first fastener 224, first receiver 925 (FIG. 9), second fastener 226, second receiver 927 (FIG. 9), third fastener 228, and/or third receiver 929 (FIG. 9) can be omitted.

Meanwhile, sole mass element 208 can comprise an exterior surface 230 and a body-side surface 953 (FIG. 9) opposite exterior surface 230. In some embodiments, sole mass element 208 can comprise one or more apertures 231. As discussed in greater detail below, aperture(s) 231 can correspond to coupling mechanism(s) 220, and more specifically, to the receiver(s) (e.g., first receiver 925 (FIG. 9), second receiver 927 (FIG. 9), and/or third receiver 929 (FIG. 9)) of coupling mechanism(s) 220. Further, sole mass element 208 can comprise one or more sole mass element thicknesses 945 (FIG. 9), one or more foremost element points 247, and/or one or more highest element points 948 (FIG. 9). As discussed in greater detail below, club head 100 can comprise a sole mass element depth 850 (FIG. 8) when sole mass element 208 is coupled to club head body 107.

Referring back to FIG. 1, face surface 109 can be located at front end 103. Crown surface 110 can be at least partially located at top end 101. Accordingly, crown surface 110 can interface with face surface 109 at top end 101, such as, for example, at a crown intersection 117 of club head body 107. Further, sole surface 211 (FIG. 2) can be at least partially located at bottom end 102. Accordingly, sole surface 211 (FIG. 2) can interface with face surface 109 at bottom end 102, such as, for example, at a sole intersection 118 of club head body 107. In many examples, crown intersection 117 and/or sole intersection 118 can be curved or faceted, providing smooth (or substantially smooth) transitions between face surface 109 and crown surface 110 and/or sole surface 211 (FIG. 2). In these embodiments, crown intersection 117 can refer to a crown radius of club head body 107 and/or sole intersection 118 can refer to a lead edge radius of club head 107. In other embodiments, crown intersection 117 and/or sole intersection 118 can be angular, providing sharp transitions between face surface 109 and crown surface 110 and/or sole surface 211 (FIG. 2).

When applicable, the skirt surface can be located between crown surface 110 and sole surface 211 (FIG. 2), and can extend between toe end 105 and heel end 106. In some embodiments, the skirt surface can extend between crown surface 110 and sole surface 211 (FIG. 2) around to face 109 at toe end 105 and/or at heel end 106, while in other embodiments, the skirt surface can extend less than all of the way to face 109 at toe end 105 and/or at heel end 106. Accordingly, crown surface 110 and sole surface 211 (FIG. 2) can interface with each other, such as, for example, at rear end 104, toe end 105, and/or heel end 106. However, in embodiments when club head body 107 comprises the skirt surface, and the skirt surface extends from face surface 109 at toe end 105 to face surface 109 at heel end 106, crown surface 110 and sole surface 211 (FIG. 2) may not interface with each other at all, but rather with the skirt surface. Like with face surface 109, the interfaces of crown surface 110 and sole surface 211 (FIG. 2) with each other and/or with the skirt surface can be smooth and/or sharp.

Face surface 109 can refer to a striking face or a striking plate of club head 100, and can be configured to impact a ball (not shown), such as, for example, a golf ball. In many embodiments, face surface 109 can comprise one or more scoring lines (e.g., grooves). The scoring line(s) can extend between toe end 105 and heel end 106.

As applicable, hosel 112, hosel transition portion 113, and the bore of club head body 107 can be located at or proximate to heel end 106. In various embodiments, an opening of the bore of club head body 107 can be located at and/or can be substantially flush with crown surface 110. Further, hosel port 214 can be located at or proximate to sole surface 211 (FIG. 2) and/or opposite the opening of the bore or an opening of hosel 112. In embodiments where club head body 107 comprises hosel 112 and/or hosel transition portion 113, the bore can be omitted, and vice versa. Hosel port 214 can be implemented with hosel 112 or the bore of club head body 107, as applicable.

Although a shaft is not illustrated at the drawings, hosel 112 and the bore of club head body 107 can be configured to receive a shaft (i.e., via the opening of the bore or hosel 112, as applicable), such as, for example, a golf club shaft. Accordingly, hosel 112 or the bore of club head body 107 can receive the shaft and permit the shaft to be coupled (e.g., permanently or removably) to club head body 107 when hosel 112 or the bore of club head body 107 receives the shaft. In some embodiments, hosel 112 or the bore of club head body 107 can be further configured to couple the shaft to club head body 107, such as, for example, via threaded coupling. Further or alternatively, and as applicable, hosel port bolt 215 (FIG. 2) can couple the shaft to club head body 107 at hosel port 214. In these embodiments, the shaft, when received at hosel 112 or the bore of club head 107, can pass through club head body 107 to hosel port 214 (FIG. 2).

Club head 100 can comprise a shaft axis 149. Shaft axis 149 refers to a reference axis (a) that can be orthogonal to the opening of hosel 112 or the bore of club head body 107, as applicable, and (b) that can intersect a center point of the applicable opening. When a shaft is coupled to club head body 107, the shaft and shaft axis 149 can be approximately co-linear.

Figure 3:
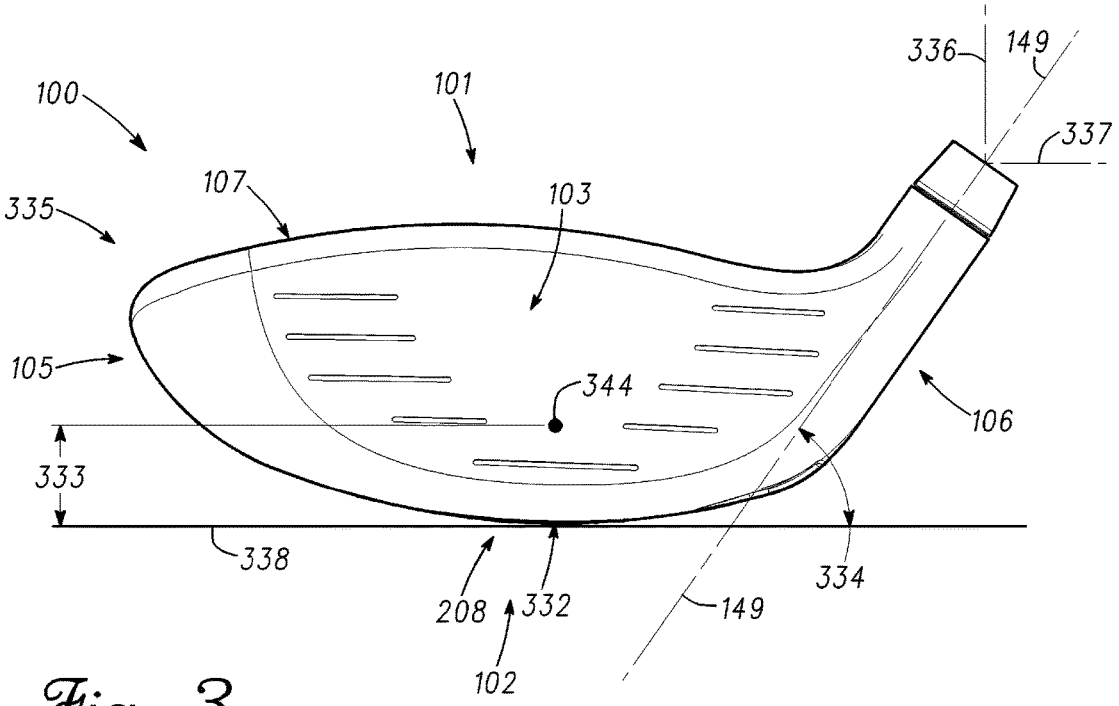
FIG. 3 illustrates a front view of a club head, according to the embodiment of FIG. 1.

Turning ahead in the drawings, FIG. 3 illustrates a front view of club head 100, according to the embodiment of FIG. 1. Club head 100 comprises a club head center of gravity (CG) 344, one or more keel points 332, a club head CG height 333, and a lie angle 334. Keel point(s) 332 can be part of one or both of club head body 107 and sole mass element 208. Further, shaft axis 149 comprises a top-bottom axis 336 and a heel-toe axis 337. Shaft axis 149 forms lie angle 334 with a ground plane 338 at a club head address configuration 335. As described further below, club head 100 can be positioned in address configuration 335.

Figure 8:
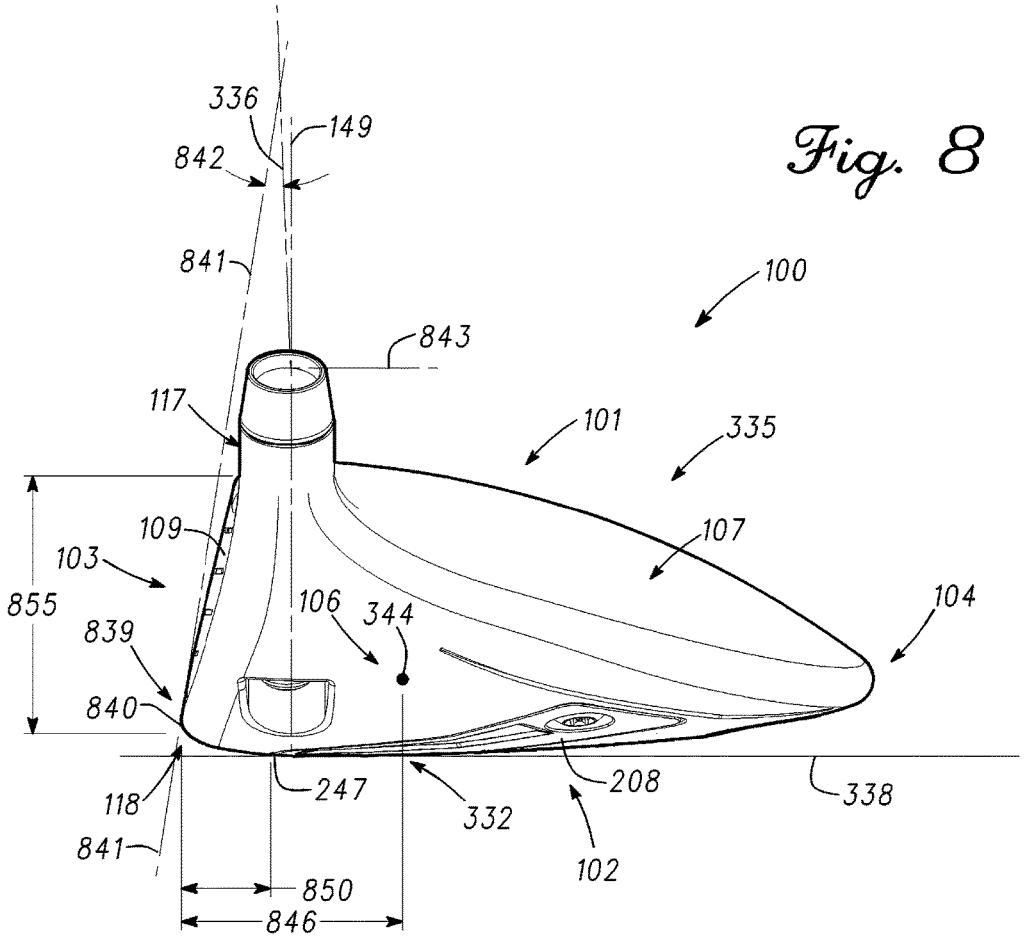
FIG. 8 illustrates a heel side view of the club head, according to the embodiment of FIG. 1.

Meanwhile, turning ahead again in the drawings, FIG. 8 illustrates a heel side view of club head 100, according to the embodiment of FIG. 1. Shaft axis 149 further comprises a front-rear axis 843. Meanwhile, club head 100, club head body 107, and/or sole mass element 208 can comprise a leading edge 839, and leading edge 839 can comprise one or more leading edge points 840. Leading edge 839 and leading edge point(s) 840 can be part of one or both of club head body 107 and sole mass element 208. Further, club head 100 comprises loft plane 841, which can form loft angle 842 with top-bottom axis 336 in a plane including top-bottom axis 336 and front-rear axis 843. Also, club head 100 can comprise a club head CG depth 846. Further still, club head 100, club head body 107, and/or face surface 109 can comprise a face height 855.

In many embodiments, top-bottom axis 336, heel-toe axis 337 (FIG. 3), and front-rear axis 843 also refer to reference axes of club head 100. Accordingly, top-bottom axis 336, heel-toe axis 337 (FIG. 3), and front-rear axis 843 can provide a Cartesian reference frame for club head 100 as component axes of shaft axis 149. In these examples, top-bottom axis 336, heel-toe axis 337 (FIG. 3), and front-rear axis 843 can each be orthogonal to each other. Further, top-bottom axis 336 can extend approximately in a direction of top end 101 and bottom end 102; heel-toe axis 337 can extend approximately in a direction of heel end 106 and toe end 105 (FIGS. 1-4 & 6-8); and/or front-rear axis 843 can extend approximately in a direction of front end 103 and rear end 104.

In many embodiments, address configuration 335 can refer to a configuration of club head 100 in which club head 100 is positioned to address a golf ball (e.g., by a user as part of a golf club) while club head 100 is in a resting state. In other embodiments, address configuration 335 can refer to a configuration of club head 100 in which club head 100 is balanced (e.g., at sole surface 211 (FIG. 2)) on a level surface (e.g., a ground surface) and acted upon only by gravity. In these or other embodiments, club head 100 can be decoupled from the shaft. In many embodiments, club head 100 can be positioned in address configuration 335 when one or more predetermined conditions exist for lie angle 334 (FIG. 3), top-bottom axis 336, heel-toe axis 337 (FIG. 3), loft angle 842, and/or front-rear axis 843.

For example, when club head 100 is positioned in address configuration 335, top-bottom axis 336 can be orthogonal to ground plane 338, heel-toe axis 337 (FIG. 3) can be parallel to ground plane 338, and/or front-rear axis 843 can be parallel to ground plane 338. Further, when club head 100 is positioned in address configuration 335, lie angle 334 (FIG. 3) can comprise a predetermined angle greater than or equal to approximately 50 degrees and less than or equal to approximately 60 degrees. In a specific example, when club head 100 is positioned in address configuration 335, lie angle 334 (FIG. 3) can be approximately 56 degrees. Further still, when club head 100 is positioned in address configuration 335, loft angle 842 can comprise a predetermined angle greater than or equal to approximately 0 degrees and less than or equal to approximately 65 degrees. In many examples, address configuration 335 and/or lie angle 334 can vary depending on loft angle 842. In various examples, loft angle 842 can be determined by a manufacturer of club head 100, as desirable.

Ground plane 338 can refer to a plane (a) that is parallel to a plane including heel-toe axis 337 (FIG. 3) and front-rear axis 843 when club head 100 is positioned in address configuration 335 and (b) that intersects or is tangent to keel point(s) 332. Keel point(s) 332 can refer to the point(s) closest to bottom end 102 and farthest from top end 101 when club head 100 is positioned in address configuration 335.

In many embodiments, as illustrated at FIG. 8, loft plane 841 can refer to a plane (a) that intersects leading edge point(s) 840 and (b) that is approximately parallel with face surface 109 when club head 100 is positioned in address configuration 335. In these or other embodiments, loft plane 841 can refer to a plane (a) that intersects a face center of face surface 109 and (b) that is approximately parallel with face surface 109 when club head 100 is positioned in address configuration 335. In many examples, the face center can refer to a location at face surface 109 that is equidistant between toe end 105 and heel end 106 and further that is equidistant between top end 101 and bottom end 102. In various examples, the face center can refer to the face center as defined at *United States Golf Association: Procedure for Measuring the Flexibility of a Golf Clubhead*, USGA-TPX 3004, Revision 1.0.0, p. 6, May 1, 2008 (retrieved Aug. 2, 2013 from http://www.usga.org/equipment/testing/protocols/Test-Protocols-For-Equipment), which is incorporated herein by reference. When face surface 109 is planar and/or substantially planar, face surface 109 and loft plane 841 can be approximately co-planar. Meanwhile, when face surface 109 is non-planar (e.g., curved), at least part of face surface 109 can be located in front of or behind loft plane 841. Leading edge 839 can refer to a line running between toe end 105 (FIGS. 1-7) and heel end 106 that is formed by and that demarcates the points of club head 100 closest to front end 103 and farthest from rear end 104 between toe end 105 (FIGS. 1-4 & 6-8) and heel end 106. Further, leading edge point(s) 840 can refer to the point(s) of leading edge 839 that are closest to front end 103 and farthest from rear end 104 as compared to the other point(s) of leading edge 839. For purposes of clarity, leading edge point(s) 840 can comprise a single point in some embodiments, but also can comprise multiple points if each of the multiple points are equally close to front end 103 and far from rear end 104.

Club head CG 344 designates the center of gravity of club head 100. Meanwhile, club head CG height 333 can refer to a distance running parallel to top-bottom axis 336 between club head CG 344 and keel point(s) 332, and club head CG depth 846 can refer to a distance running parallel to front-rear axis 843 between club head CG 344 and leading edge point(s) 840.

Face height 855 can refer to a distance running parallel to top-bottom axis 336 between crown intersection 117 and sole intersection 118. In other embodiments, face height 855 can refer to a distance running parallel to loft plane 841 between crown intersection 117 and sole intersection 118.

Referring now back to FIG. 2, sole mass element 208 can be permanently or removably coupled to club head body 107. Here, permanent coupling is to be distinguished from removable coupling by way of design intent and not necessarily according to a physical possibility of decoupling and recoupling sole mass element 208 to club head body 107. That is to say, when sole mass element 208 is removably coupled to club head body 107, it is intended that sole mass element 208 can be readily coupled/decoupled from club head body 107 (e.g., by a user) as desired; whereas, when sole mass element 208 is permanently coupled to club head body 107, it is intended that sole mass element 208 and club head body 107 will remain coupled. The design intent of the coupling can dictate the manner of coupling implemented as some manners of coupling would be more easily separable than others.

In some embodiments, sole mass element 208 can be part or all of sole surface 211, such as, for example, when sole mass element 208 is permanently coupled to club head body 107 and/or when sole surface 211 consists of sole mass element 208 entirely. Meanwhile, in other embodiments, sole mass element 208 can be separate from sole surface 211, such as, for example, when sole mass element 208 is removably coupled to club head body 107.

Although sole mass element 208 can be coupled to club head body 107 in any suitable manner, in many embodiments, sole mass element 208 can be coupled to club head body 107 mechanically (e.g., via one or more coupling mechanisms and/or via a friction fit, etc.) and/or by bonding (e.g., via welding, via crimping, via brazing, via soldering, and/or via adhesive, etc.). As applicable, sole mass element 208 can be coupled to club head body 107 via any suitable coupling mechanism(s) (e.g., (a) one or more fasteners, such as, for examples, one or more screws, one or more bolts, etc. and one or more receivers corresponding to the fasteners and/or (b) one or more magnets). For example, sole mass element 208 can be coupled to club head body 107 via coupling mechanisms 220, such as, for example, via first coupling mechanism 221 (e.g., first fastener 224 and first receiver 925 (FIG. 9)), second coupling mechanism 222 (e.g., second fastener 226 and second receiver 927 (FIG. 9)), and/or third coupling mechanism 223 (e.g., third fastener 228 and third receiver 929 (FIG. 9)). In these or other embodiments, as applicable, sole mass element 208 can be coupled to club head body 107 via any suitable adhesive(s), such as, for example, tape (e.g., double-sided very high bond tape) and/or epoxy. Implementing multiple manners of coupling sole mass element 208 to club head body 107 simultaneously can provide additional factors of safety if a concern exists that sole mass element 208 could decouple from club head body 107, such as, for example, while in operation.

Although sole mass element 208 can be configured in any suitable manner, in many embodiments, sole mass element 208 can comprise a plate. The advantages of configuring sole mass element 208 as a plate are discussed in greater detail below.

Exterior surface 230 can refer to a surface of sole mass element 208 facing outward and away from club head body 107 when sole mass element 208 is coupled to club head body 107. In many embodiments, exterior surface 230 can also refer to an exposed surface of sole mass element 208 when sole mass element 208 is coupled to club head body 107. In these embodiments, sole element mass 208 can be received at sole mass element cavity 219, as described below, such that exterior surface 230 is exposed and part or all of a remaining surface of sole element mass 208 (e.g., body-side surface 953 (FIG. 9)) is covered by club head body 107. Accordingly, body-side surface 953 (FIG. 9) can refer to a surface facing inward and toward club head body 107 when sole mass element 208 is coupled to club head body 107.

Aperture(s) 231 can be aligned with the receiver(s) of coupling mechanism(s) 220 (e.g., first receiver 925, second receiver 927, and/or third receiver 929), and the fastener(s) of coupling mechanism(s) 220 (e.g., first fastener 224, second fastener 226, and/or third fastener 228) can be received at the receiver(s) of coupling mechanism(s) 220 and at aperture(s) 231 (i.e., passing through aperture(s) 231 to the receiver(s) of coupling mechanism(s) 220) to couple sole mass element 208 to club head body 107. In these examples, aperture(s) 231 and/or the receiver(s) of coupling mechanism(s) 220 can be threaded, permitting the complimentary threaded fastener(s) of coupling mechanism(s) 220 to be coupled thereto and thereby coupling sole mass element 208 to club head body 107.

Sole mass element cavity 219 can be configured to receive sole mass element 208, and sole mass element 208 can be coupled to club head body 107 at sole mass element cavity 219. Sole mass element 208 can approximately conform in shape to sole mass element cavity 219. In these embodiments, sole mass element 208 and sole mass element cavity 219 can comprise similar or identical volumes. For example, a volume of sole mass element 208 and a volume of sole mass element cavity 219 can be approximately equal. Accordingly, when sole mass element cavity 219 receives sole mass element 208, exterior surface 230 can be flush with sole surface 211, forming a continuous surface therewith. Further, aperture(s) 231 can be countersunk so that coupling mechanism(s) 220 do not extend beyond exterior surface 230 and/or sole surface 211. In general, it can be desirable to configure club head 100 to permit club head 100 to pass smoothly along a ground surface below it. Implementing the foregoing can help to permit club head 100 to pass smoothly along a ground surface below it.

Turning ahead again to FIG. 8, club head 100 can comprise a sole mass element depth 850, and sole mass element 208 can comprise foremost element point(s) 247 when sole mass element 208 is coupled to club head body 107. Introduced above, foremost element point(s) 247 can refer to the point(s) of sole mass element 208 when sole mass element 208 is coupled to club head body 107 that are (a) closest to front end 103 and farthest from rear end 104 and/or (b) closest to leading edge point(s) 840 in a direction running parallel to front-rear axis 843. Meanwhile, sole mass element depth 850 can refer to a distance running parallel to front-rear axis 843 between foremost element point(s) 247 and leading edge point(s) 840 when sole mass element 208 is coupled to club head body 107.

Meanwhile, turning to the next drawing, FIG. 9 illustrates club head 100 when sole mass element 208 is decoupled from club head body 107, according to the embodiment of FIG. 1. Club head body 107, sole surface 211, and/or sole mass element cavity 219 can comprise cavity wall 954 and cavity surface 952, which can be part of cavity wall 954 and which can correspond to body-side surface 953. That is, cavity surface 952 can receive body-side surface 953 when sole mass element 208 is coupled to club head body 107. Cavity wall 954 can also comprise one or more sidewalls corresponding to one or more sidewalls of sole mass element 208. However, in some embodiments, the sidewall(s) of cavity wall 954 and/or sole mass element 208 can be omitted. When implementing club head 100 with coupling mechanism(s) 220 (FIG. 2), in many embodiments, cavity surface 952 can comprise the receiver(s) of coupling mechanism(s) 220 (FIG. 2), though in these or other embodiments, part (or all in still other embodiments) of the receiver(s) of coupling mechanism(s) 220 (FIG. 2) can be part of the sidewalls of cavity wall 954, as applicable.

Further, club head 100 can comprise a sole mass element height 951 and sole mass element 208 can comprise highest element point(s) 948 when sole mass element 208 is coupled to club head body 107. Highest element point(s) 948 can refer to the point(s) of sole mass element 208 that are (a) closest to top end 101 (FIGS. 1-5, 7, & 8) and farthest from bottom end 102 (FIGS. 1-4 & 6-8) and/or (b) farthest from keel point(s) 332 in a direction running parallel to top-bottom axis 336 (FIGS. 3 & 8) when sole mass element 208 is coupled to club head body 107. Further, sole mass element height 951 can refer to a distance running parallel to top-bottom axis 336 (FIGS. 3 & 8) between highest element point(s) 948 and keel point(s) 332 when sole mass element 208 is coupled to club head body 107.

For purposes of illustration only, highest element point(s) 948, sole mass element height 951, and keel point(s) 332 are illustrated at sole mass element 208 as shown in FIG. 9 even though sole mass element 208 is decoupled from club head body 107. More specifically, the positions of highest element point(s) 948, sole mass element height 951, and keel point(s) 332 are relative to and a function of the coupling of sole mass element 208 to club head body 107 and/or the particular address configuration 335 (FIGS. 3 & 8) of club head 100. Accordingly, at FIG. 9, assumed positions of highest element point(s) 948 and keel point(s) 332 (e.g., at sole mass element 208) are provided to express their relationship with sole mass element height 951 because illustration of the relationship of these elements to each other may be better appreciated when viewing sole mass element 208 apart from club head body 107. Nonetheless, these positions may be subject to change when sole mass element 208 is coupled to club head body 107.

Club head 100, club head body 107, and sole mass element 208 can be configured so that coupling sole mass element 208 to club head body 107 distributes more of the mass of club head 100 to be (a) closer to sole surface 211 and/or bottom end 102 (FIGS. 1-4 & 6-8), (b) farther from face surface 109 and/or front end 103 (FIGS. 1-3 & 5-8), and/or (c) closer to toe end 105 (FIGS. 1-7) and/or heel end 106 (FIGS. 1-3 & 8). Accordingly, coupling sole mass element 208 to club head body 107 can alter club head CG 344 (FIGS. 3 & 8) and/or a moment of inertia of club head 100. Indeed, coupling sole mass element 208 to club head body 107 can increase a moment of inertia of club head 100 about front-rear axis 843 (FIGS. 3 & 8) and/or heel-toe axis 337 (FIG. 3). In turn, coupling sole mass element 208 to club head body 107 can alter club head 100 to improve various performance characteristics thereof, such as, for example, a flight angle of a golf ball struck with club head 100, a flight distance of the golf ball struck with club head 100, and/or a forgiveness of golf club 100 when striking the golf ball.

Selective shape, placement, and/or orientation of sole mass element 208 when coupled to club head body 107 can distribute more of the mass of club head 100 to be (a) farther from face surface 109 and/or front end 103 (FIGS. 1-3 & 8) and/or (b) closer to toe end 105 (FIGS. 1-3 & 8) and/or heel end 106 (FIGS. 1-3 & 8). Meanwhile, configuring sole mass element 208 so that the mass and/or density of sole mass element 208 is as high as possible and/or so that the volume of sole mass element 208 is located as low (e.g., close to the ground) as possible when club head 100 is positioned in address configuration 335 (FIGS. 3 & 8) can distribute more of the mass of club head 100 to be closer to sole surface 211 and/or bottom end 102 (FIGS. 1-3 & 8).

Accordingly, in many embodiments, part or all of club head body 107 can comprise pure or alloyed titanium (e.g., SSAT 2014 Beta titanium, SP700 Beta titanium, Ti5N Beta titanium, TI 15-5-4-4 Beta titanium, Ti 811, etc.). In some embodiments, different parts of club head body 107 can comprise different titanium and/or titanium alloy materials. The relatively low mass of titanium and titanium alloys when compared to many other materials (e.g., metals) can permit increased discretion as to the distribution of the remaining mass of club head 100, which can be particularly advantageous when the mass of club head 100 is subject to constraint. In these or other embodiments, club head body 107 can be formed by casting. However, other suitable techniques for providing club head body 107 can also be implemented.

Using titanium or titanium alloys for club head body 107 can permit face surface 109 to be thinner than would be possible for many other suitable materials due to the high material strength of titanium and titanium alloys. Specifically, face surface 109 can be thinner when comprising titanium or titanium alloys than may be possible with other materials. As a result, a characteristic time of club head 100 can also be improved.

Further, part or all of sole mass element 208 can comprise a higher density material than club head body 107, such as, for example, pure or alloyed tungsten. Exemplary tungsten alloys can include tungsten and iron and/or nickel. In many embodiments, sole mass element 208 can comprise a material having a specific gravity greater than or equal to approximately 14, 15, or 16. In these or other embodiments, the specific gravity can be less than or equal to approximately 17. In some embodiments, sole mass element 208 can be formed by metal injection molding. However, other suitable techniques for providing sole mass element 107 can also be implemented, such as, for example, machining sole mass element 208.

The manner of coupling sole mass element 208 to club head body 107 can affect the permissible specific gravity of sole mass element 208. For example, coupling by certain bonding techniques (e.g., brazing) can cause fracture and poor joint formation to occur if the material of sole mass element 208 is too brittle. In some examples, the material can become more brittle as its specific gravity increases. Accordingly, using other coupling techniques, such as, for example, mechanical coupling mechanisms (e.g., coupling mechanism(s) 220 (FIG. 2)) can permit for the use of materials for sole mass element 208 having higher specific gravities than might be possible for other manners of coupling. Manufacturing costs also can constrain the manner of coupling.

Meanwhile, sole mass element 208 can be configured so that the mass of sole mass element 208 and furthermore the mass of club head 100 sits as low (e.g., close to the ground) as possible when club head 100 is positioned in address configuration 335 (FIGS. 3 & 8). Accordingly, sole mass element 208 can be configured as a plate, as discussed above, to maximize the mass of sole mass element 208 while also keeping the mass of sole mass element 208 as low as possible. As a result, it can be desirable to permit exterior surface 230 (FIG. 2) to comprise as much surface area as possible. Indeed, in certain embodiments, as discussed above, sole mass element 208 can actually be sole surface 211. Further, it can be desirable to limit a thickness of sole mass element 208 (e.g., a distance between exterior surface 230 (FIG. 2) and body-side surface 953 (FIG. 9) as much as possible. In some embodiments, sole mass element 208 can comprise a variable thickness, but in many embodiments, sole mass element 208 can comprise an approximately constant thickness, which may permit for better (e.g., cheaper and/or more efficient) manufacturing.

Further, to reserve more mass for sole mass element 208 and thereby distribute more of the mass of club head 100 as low (e.g., close to the ground) as possible when club head 100 is positioned in address configuration 335 (FIGS. 3 & 8), the mass of club head body 107 can be reduced and/or minimized, as and/or where desirable. In many examples, mass can be reserved for sole mass element 208 by hollowing club head 100 and by reducing and/or minimizing a thickness of face surface 109, crown surface 110, sole surface 211 (e.g., cavity wall 954), hosel 112 (i.e., when applicable) and/or the skirt surface of club head 100 (i.e., when applicable). Likewise, it may be possible to reserve mass for sole mass element 208 by reducing and/or minimizing the amount of material reinforcing the receiver(s) of coupling mechanism(s) 220 (e.g., first receiver 925, second receiver 927, and/or third receiver 929) when coupling mechanism(s) 220 (FIG. 2) are implemented.

For example, sole surface 211, cavity wall 244, and/or one or more of the receiver(s) of coupling mechanism(s) 220 (e.g., first receiver 925, second receiver 927, and/or third receiver 929) can comprise conical or cylindrical reinforcement(s) to reduce and/or minimize mass at club head body 107 and reserve additional mass for sole mass element 208. The reinforcement(s) can be countersunk at sole surface 211 and/or cavity wall 954 (e.g., around the receiver(s) of coupling mechanism(s) 220 (FIG. 2)), such as, for example, when aperture(s) 231 at sole mass element 208 are countersunk so as to receive the countersunk portions of aperture(s) 231.

Moreover, sole mass element 208 can be located below and/or aligned with a geometric center of face surface 109. Locating sole mass element 208 below and/or aligning sole mass element 208 with the geometric center of face surface 109 can improve the forgiveness of club head 100. As a result, impacting golf balls low on face surface 109 (e.g., where many users commonly do) can provide similar results to impacting golf balls at a center of face surface 109.

In some embodiments, the fastener(s) for coupling mechanism(s) 220 (e.g., first fastener 224, second fastener 226, and/or third fastener 228) can comprise any suitable material, such as, for example, steel, tungsten, tungsten alloy, etc.

As introduced above, some embodiments of club head 100 can comprise weight port(s) 216, each of which can be configured to receive one or more of weight(s) 956. In many embodiments, applying weight(s) 956 to weight port(s) 216 (FIG. 2) can further alter center of gravity 344 (FIGS. 3 & 8) and/or a moment of inertia of club head 100, such as, for example, to distribute the mass of club head 100 to be (a) closer to sole surface 211 and/or bottom end 102 (FIGS. 1-4 & 6-8), (b) farther from face surface 109 and/or front end 103 (FIGS. 1-3 & 5-8), and/or (c) closer to toe end 105 (FIGS. 1-7) and/or heel end 106 (FIGS. 1-6 & 8). In many examples, the material(s) of weight(s) 956 can be similar or identical to the material(s) of sole mass element 208.

In some examples, club head CG height 333 (FIG. 3) can be less than or equal to approximately 1.415 centimeters. In further examples, club head CG height 333 (FIG. 3) can be less than or equal to approximately 1.2 centimeters. In still further examples, club head CG height 333 (FIG. 3) can be less than or equal to approximately 1.1 centimeters.

In some examples, club head CG depth 846 (FIG. 8) can be greater than or equal to approximately 3.431 centimeters. In further examples, club head CG depth 846 (FIG. 8) can be greater than or equal to approximately 4.064 centimeters. In other examples, club head CG depth 846 (FIG. 8) can be greater than or equal to approximately 3.431 centimeters and/or less than or equal to approximately 4.064 centimeters. In still other examples, club head CG depth 846 (FIG. 8) can be greater than or equal to approximately 2.54 centimeters and/or less than or equal to approximately 4.064 centimeters.

In some examples, sole mass element depth 850 (FIG. 8) can be greater than or equal to approximately 0.947 centimeters and/or less than or equal to approximately 1.306 centimeters.

In some examples, sole mass element height 951 can be less than or equal to approximately 1.651 centimeters. In further examples, sole mass element height 951 can be less than or equal to approximately 1.397 centimeters. In still further examples, sole mass element height 951 can be less than or equal to approximately 1.143 centimeters. In yet further examples, sole mass element height 951 can be less than or equal to approximately 0.889 centimeters.

In some examples, face height 855 (FIG. 8) can be greater than or equal to approximately 8.1 centimeters and/or less than or equal to approximately 8.7 centimeters.

In some examples, the surface area of exterior surface 230 (FIG. 2) can be greater than or equal to approximately 3 square centimeters and/or less than or equal to approximately 39 square centimeters. In further examples, the surface area of exterior surface 230 (FIG. 2) can be greater than or equal to approximately 15 square centimeters. In still further examples, the surface area of exterior surface 230 (FIG. 2) can be greater than or equal to approximately 19 square centimeters.

In some examples, the maximum thickness of sole mass element 208 can be less than or equal to approximately 0.4 centimeters. In further examples, the maximum thickness of sole mass element 208 can be less than or equal to approximately 0.191 centimeters. In still further examples, the maximum thickness of sole mass element 208 can be greater than or equal to approximately 0.165 centimeters.

In some examples, cavity wall 954 can comprise a thickness greater than or equal to approximately 0.076 centimeters and/or less than or equal to approximately 0.254 centimeters.

In some examples, the mass of sole mass element 208 can be greater than or equal to approximately 53 grams. In further examples, the mass of sole mass element 208 can be greater than or equal to approximately 54 grams. In other examples, the mass of sole mass element 208 can be greater than or equal to approximately 57 grams.

In some examples, the mass of club head 100 can be greater than or equal to approximately 212 grams. In these examples, the mass of club head 100 can be greater than or equal to approximately 224 grams. In further examples, the mass of club head 100 can be approximately 213 or 216 grams.

In some examples, the mass of sole mass element 208 can account for greater than or equal to approximately 20% of the mass of club head 100. In these or other examples, the mass of sole mass element 208 can account for less than or equal to approximately 35% of the mass of club head 100.

In many examples, a ratio of club head CG height 333 (FIGS. 3 & 8) to face height 855 (FIG. 8) can be less than or equal to approximately 0.36. In further examples, a ratio of club head CG height 333 (FIGS. 3 & 8) to face height 855 (FIG. 8) can be less than or equal to approximately 0.34.

In some examples, a surface area of face surface 109 can be less than or equal to approximately 30 square centimeters. In other examples, a surface area of face surface 109 can be greater than approximately 30 square centimeters.

In some examples, a volume of club head 100 can be less than or equal to approximately 300 cubic centimeters. In other examples, a volume of club head 100 can be greater than approximately 300 cubic centimeters.

Figure 4:
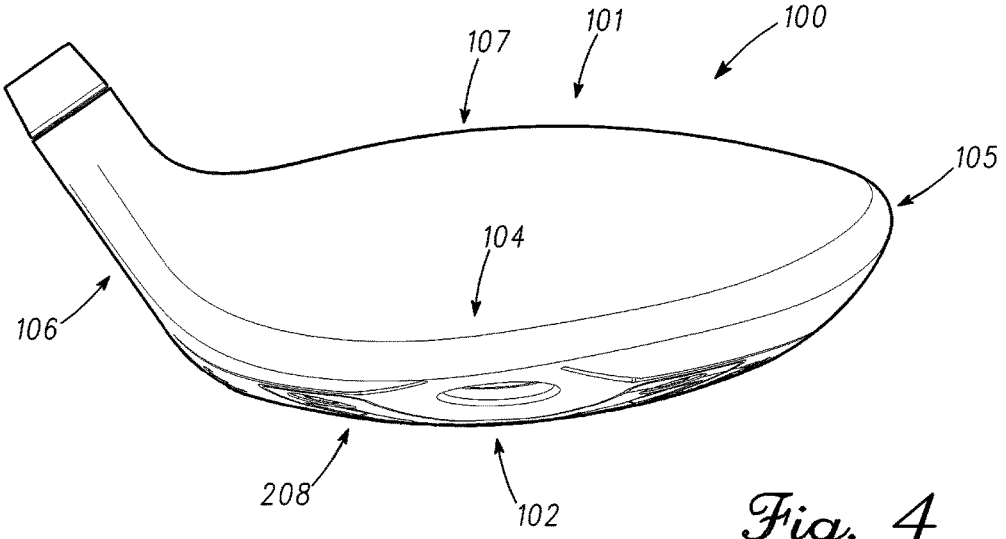
FIG. 4 illustrates a rear view of the club head, according to the embodiment of FIG. 1.
Figure 5:
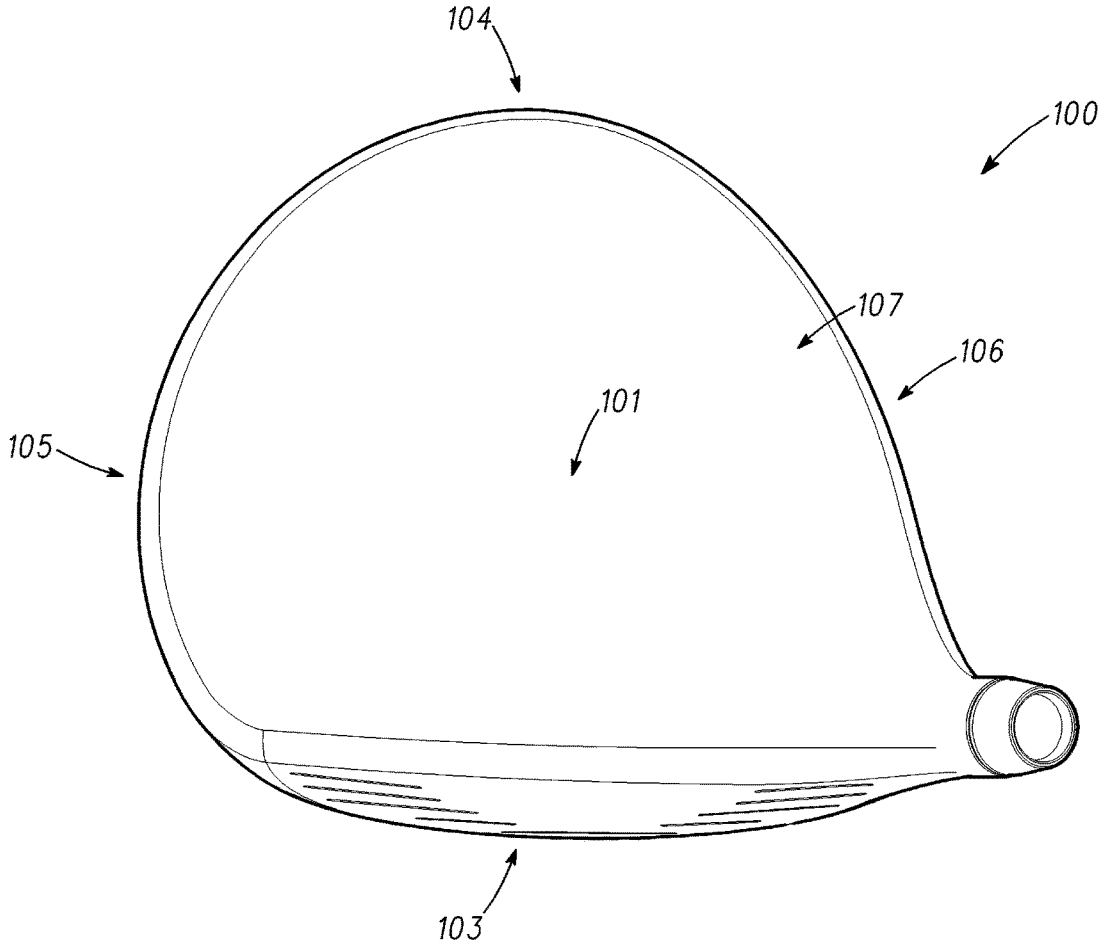
FIG. 5 illustrates a top view of the club head, according to the embodiment of FIG. 1.
Figure 6:
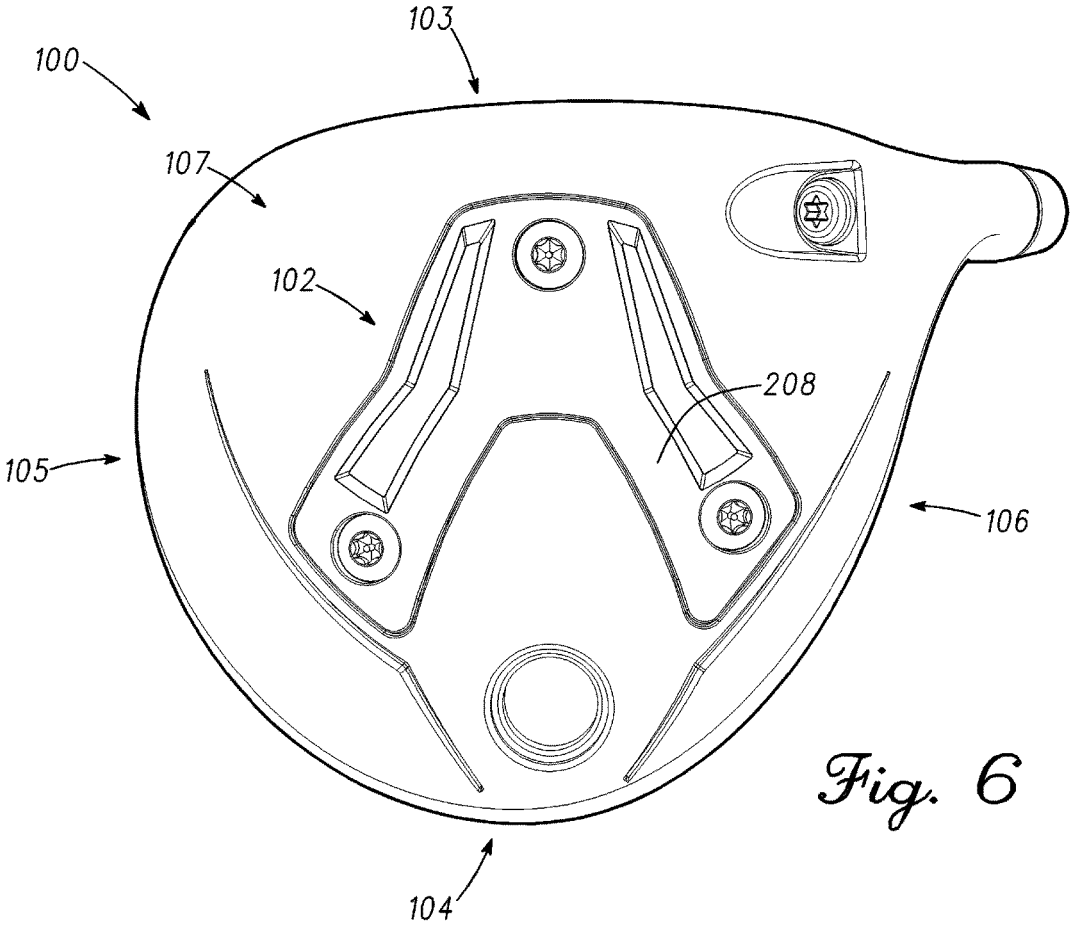
FIG. 6 illustrates a bottom view of the club head, according to the embodiment of FIG. 1.
Figure 7:
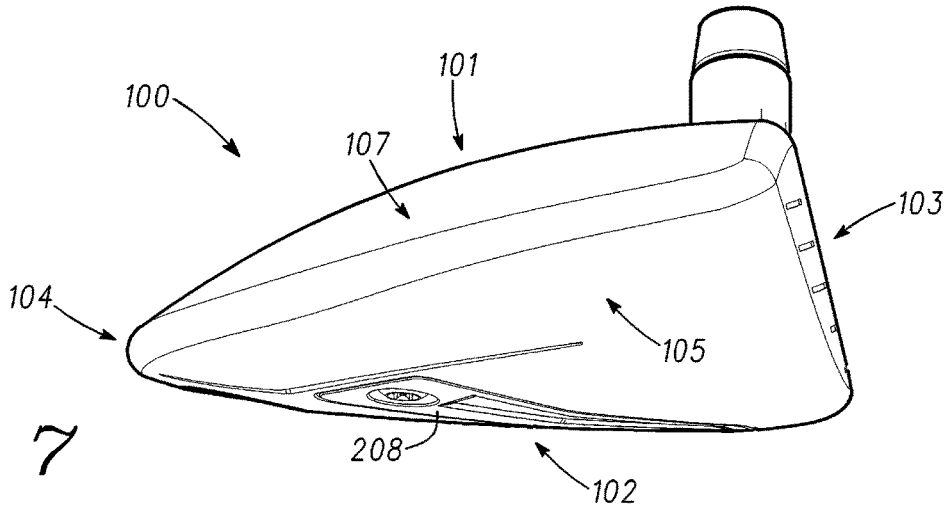
FIG. 7 illustrates a toe side view of the club head, according to the embodiment of FIG. 1

Turning back in the drawings, FIGS. 4-7 illustrate club head 100 from various other viewing angles. Specifically, FIG. 4 illustrates a rear view of club head 100, according to the embodiment of FIG. 1; FIG. 5 illustrates a top view of club head 100, according to the embodiment of FIG. 1; FIG. 6 illustrates a bottom view of club head 100, according to the embodiment of FIG. 1; and FIG. 7 illustrates a toe side view of club head 100, according to the embodiment of FIG. 1.

In many embodiments, club head 100 (FIGS. 1-9) can comprise one or more branding and/or other symbols, such as, for example, to indicate a manufacturer of club head 100. In other embodiments, the branding and/or other symbol(s) can be omitted.

Figure 10:
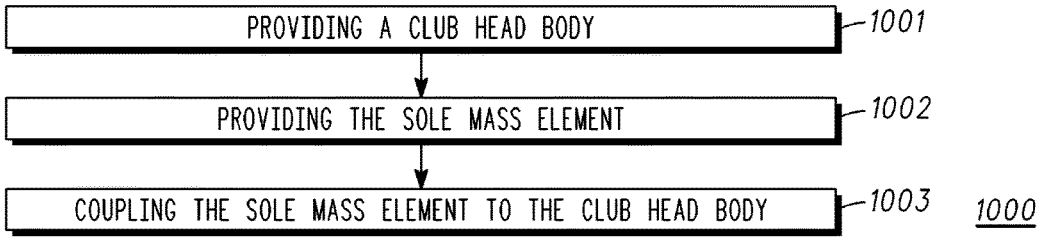
FIG. 10 illustrates a flow chart for an embodiment of a method of providing a club head.

Turning ahead in the drawings, FIG. 10 illustrates a flow chart for an embodiment of method 1000 of providing a club head. Method 1000 is merely exemplary and is not limited to the embodiments presented herein. Method 1000 can be employed in many different embodiments or examples not specifically depicted or described herein. In some embodiments, the activities, the procedures, and/or the processes of method 1000 can be performed in the order presented. In other embodiments, the activities, the procedures, and/or the processes of method 1000 can be performed in any other suitable order. In still other embodiments, one or more of the activities, the procedures, and/or the processes in method 1000 can be combined or skipped. In many embodiments, the club head can be similar or identical to club head 100 (FIGS. 1-9).

Figure 11:
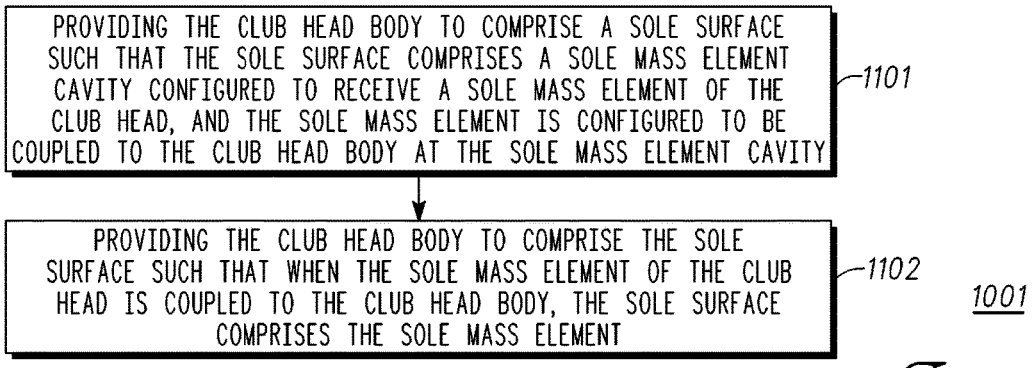
FIG. 11 illustrates an exemplary method of providing a club head body, according to the embodiment of FIG. 1.

Method 1000 comprises activity 1001 of providing a club head body. The club head body can be similar or identical to club head body 107 (FIGS. 1-9). FIG. 11 illustrates an exemplary activity 1001.

Referring to FIG. 11, activity 1001 can comprise activity 1101 of providing the club head body to comprise a sole surface such that the sole surface comprises a sole mass element cavity configured to receive a sole mass element of the club head, and the sole mass element is configured to be coupled to the club head body at the sole mass element cavity. The sole surface can be similar or identical to sole surface 211 (FIG. 2); the sole mass element cavity can be similar or identical to sole mass element cavity 219 (FIGS. 2 & 9); and/or the sole mass element can be similar or identical to sole mass element 208 (FIGS. 2-4 & 6-9).

Activity 1001 can comprise activity 1102 of providing the club head body to comprise the sole surface such that when the sole mass element of the club head is coupled to the club head body, the sole surface comprises the sole mass element. In some embodiments, when activity 1101 is performed, activity 1102 can be omitted, and vice versa.

Figure 12:
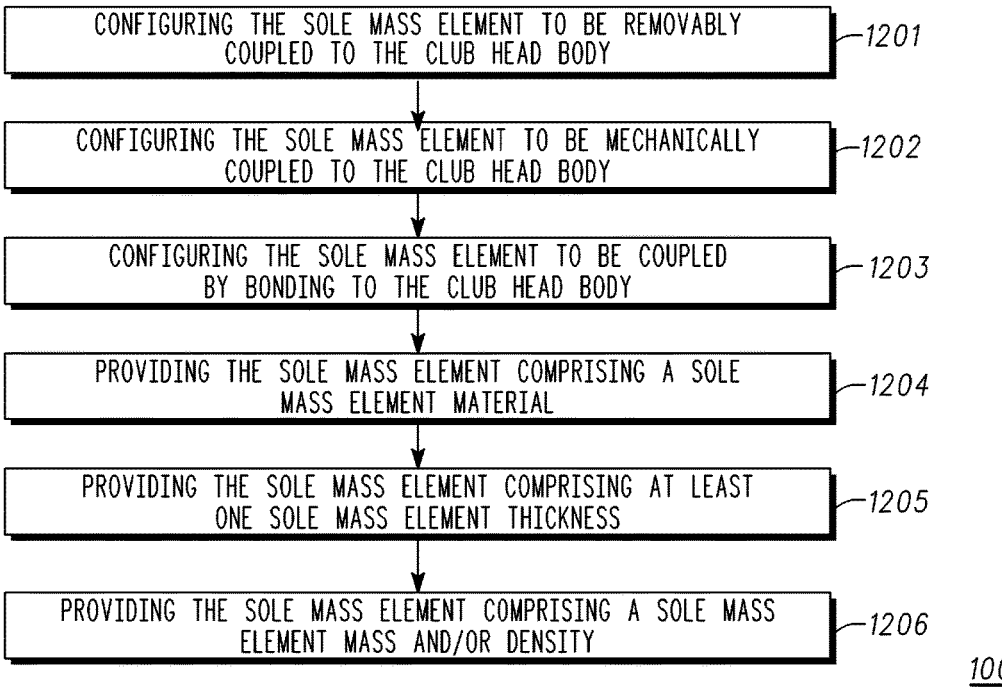
FIG. 12 illustrates an exemplary method of providing a sole mass element, according to the embodiment of FIG. 1.

Returning again to FIG. 10, method 1000 comprises activity 1002 of providing the sole mass element. FIG. 12 illustrates an exemplary activity 1002.

Referring to FIG. 12, activity 1002 can comprise activity 1201 of configuring the sole mass element to be removably coupled to the club head body.

Activity 1002 can comprise activity 1202 of configuring the sole mass element to be mechanically coupled to the club head body.

Activity 1002 can comprise activity 1203 of configuring the sole mass element to be coupled by bonding to the club head body. In some embodiments, one or more of activities 1201-1203 can be omitted.

Activity 1002 can comprise activity 1204 of providing the sole mass element comprising a sole mass element material. The sole mass element material can be similar or identical to the material(s) described above with respect to sole mass element 208 (FIGS. 2-4 & 6-9).

Activity 1002 can comprise activity 1205 of providing the sole mass element comprising at least one sole mass element thickness. The sole mass element thickness(es) can be similar or identical to the thickness(es) described above with respect to sole mass element 208 (FIGS. 2-4 & 6-9).

Activity 1002 can comprise activity 1206 of providing the sole mass element comprising a sole mass element mass and/or density. The sole mass element mass and/or density can be similar or identical to the mass and/or density described above with respect to sole mass element 208 (FIGS. 2-4 & 6-9). The sequence of activities 1204, 1205, and 1206 can be in any order or simultaneous with each other.

Turning back to FIG. 10, method 1000 can comprise activity 1003 of coupling the sole mass element to the club head body.

Although the golf club heads and related methods herein have been described with reference to specific embodiments, various changes may be made without departing from the spirit or scope of the present disclosure. For example, to one of ordinary skill in the art, it will be readily apparent that activities 1001-1003 of FIG. 10, activities 1101 and 1102 of FIG. 11, and/or activities 1201-1206 of FIG. 12 may be comprised of many different procedures, processes, and activities and be performed by many different modules, in many different orders, that any element of FIGS. 1-12 may be modified, and that the foregoing discussion of certain of these embodiments does not necessarily represent a complete description of all possible embodiments.

Further, while the above examples may be described in connection with a wood-type golf club head, the apparatus, methods, and articles of manufacture described herein may be applicable to other types of golf clubs such as an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a club head body; and a sole mass element configured to be coupled to the club head body;

wherein:

the golf club head comprises a club head center of gravity (CG);

the golf club head comprises at least one keel point;

the sole mass element is configured as a plate;

the club head CG comprises a club head CG height, the club head CG height being a distance that is parallel to a top-bottom axis of the golf club head between the club head CG and the at least one keel point;

when the sole mass element is coupled to the club head body, the sole mass element comprises an exposed surface;

the exposed surface of the sole mass element comprises a surface area; and the surface area of the exposed surface of the sole mass element is greater than or equal to approximately 15 square centimeters.

2. The golf club head of claim 1 wherein:

the surface area of the exposed surface of the sole mass element is greater than or equal to approximately 19 square centimeters.

3. The golf club head of claim 1 wherein:

when the sole mass element is coupled to the club head body, the club head CG height is less than or equal to approximately 1.415 cm.

4. The golf club head of claim 1 wherein:
the club head body comprises a sole surface; and
at least one of:
(a) the sole surface comprises a sole mass element cavity configured to receive the sole mass element, and
the sole mass element is configured to be coupled to the club head body at the sole mass element cavity;
or
(b) when the sole mass element is coupled to the club head body, the sole surface comprises the sole mass element.

5. The golf club head of claim 1 wherein at least one of:
the sole mass element is configured to be removably coupled to the club head body; or
the sole mass element is configured to be mechanically coupled to the club head body.

6. The golf club head of claim 1 wherein:
the sole mass element comprises a sole mass element material; and
at least one of:
the sole mass element material comprises a specific gravity greater than or equal to approximately 16; or
the sole mass element material comprises a metal injection molded material.

7. The golf club head of claim 1 wherein:
the sole mass element comprises at least one sole mass element thickness;
the at least one sole mass element thickness comprises a maximum thickness; and
at least one of:
the maximum thickness is less than or equal to approximately 0.4 centimeters; or
the at least one sole mass element thickness is one substantially constant thickness, the one substantially constant thickness being the maximum thickness.

8. The golf club head of claim 1 wherein:
the sole mass element comprises a sole mass element mass;
the golf club head comprises a golf club head mass, the golf club head mass comprising the sole mass element mass; and
the sole mass element accounts for greater than or equal to approximately 20% of the golf club head mass.

9. The golf club head of claim 8 wherein:
the sole mass element accounts for greater than or equal to approximately 20% of the golf club head mass and less than or equal to approximately 35% of the golf club head mass.

10. The golf club head of claim 1 wherein:
the golf club head comprises a leading edge;
the leading edge comprises at least one leading edge point; and
the club head CG comprises a club head CG depth, the club head CG depth being a second distance that is parallel to a face-rear axis of the golf club head between the club head CG and each of the at least one leading edge point; and
when the sole mass element is coupled to the club head body, the club head CG depth is greater than or equal to approximately 2.54 centimeters.

11. The golf club head of claim 1 wherein:
the golf club head comprises a leading edge;
the leading edge comprises at least one leading edge point;
the sole mass element comprises at least one foremost element point;
the golf club head comprises a sole mass element depth when the sole mass element is coupled to the club head body, the sole mass element depth being a second distance that is parallel to a face-rear axis of the golf club head between the at least one leading edge point and the at least one lead element point; and
the sole mass element depth is greater than or equal to approximately 0.947 centimeters.

12. The golf club head of claim 1 wherein:
the sole mass element comprises at least one highest element point;
the golf club head comprises a sole mass element height when the sole mass element is coupled to the club head body, the sole mass element height being a second distance that is parallel to the top-bottom axis of the golf club head between the at least one highest element point and the at least one keel point; and
the sole mass element height is less than or equal to approximately 1.651 centimeters.

13. The golf club head of claim 1 wherein:
the club head body comprises a face surface;
the face surface comprises a face height; and
a ratio of the club head CG height to the face height is less than or equal to approximately 0.36.

14. The golf club head of claim 1 wherein:
the golf club head comprises a wood-type golf club head.

15. The golf club head of claim 1 wherein at least one of:
the club head body comprises a face surface, and the face surface comprises a face surface area less than or equal to approximately 30 square centimeters; or
the golf club head comprises a volume less than or equal to approximately 300 cubic centimeters.

16. A golf club head comprising:
a club head body comprising a sole surface; and
a sole mass element configured to be coupled to the club head body;
wherein:
the golf club head comprises a club head center of gravity (CG);
the golf club head comprises at least one keel point;
the sole mass element is configured as a plate;
the club head CG comprises a club head CG height, the club head CG height being a distance that is parallel to a top-bottom axis of the golf club head between the club head CG and the at least one keel point;
when the sole mass element is coupled to the club head body, the sole mass element comprises an exposed surface;
the exposed surface of the sole mass element comprises a surface area;
the surface area of the exposed surface of the sole mass element is greater than or equal to approximately 15 square centimeters;
the sole surface comprises a sole mass element cavity configured to receive the sole mass element;
the sole mass element is configured to be coupled to the club head body at the sole mass element cavity;
the sole mass element is configured to be removably coupled to the club head body;
the sole mass element is configured to be mechanically coupled to the club head body;
the sole mass element comprises a sole mass element material; and at least one of:

the sole mass element material comprises a specific gravity greater than or equal to approximately 16; or the sole mass element material comprises a metal injection molded material.

17. A method of providing a golf club head, the method comprising:

providing a club head body;

providing a sole mass element configured to be coupled to the club head body; and wherein:

the golf club head comprises a club head center of gravity (CG);

the golf club head comprises at least one keel point;

the sole mass element is configured as a plate;

the club head CG comprises a club head CG height, the club head CG height being a distance that is parallel to a top-bottom axis of the golf club head between the club head CG and the at least one keel point;

when the sole mass element is coupled to the club head body, the sole mass element comprises an exposed surface;

the exposed surface of the sole mass element comprises a surface area; and the surface area of the exposed surface of the sole mass element is greater than or equal to approximately 15 square centimeters.

18. The method of claim 17 wherein:

providing the club head body comprises providing the club head body to comprise a sole surface such that at least one of:

(a) the sole surface comprises a sole mass element cavity configured to receive the sole mass element, and the sole mass element is configured to be coupled to the club head body at the sole mass element cavity;

or (b) when the sole mass element is coupled to the club head body, the sole surface comprises the sole mass element.

19. The method of claim 17 wherein at least one of:

providing the sole mass element comprises configuring the sole mass element to be removably coupled to the club head body; or providing the sole mass element comprises configuring the sole mass element to be mechanically coupled to the club head body.

20. The method of claim 17 wherein:

providing the sole mass element comprises providing the sole mass element comprising a sole mass element mass;

the golf club head comprises a golf club head mass, the golf club head mass comprising the sole mass element mass; and the sole mass element accounts for greater than or equal to approximately 20% of the golf club head mass.

* * * * *